United States Patent [19]

Breslow

[11] 4,094,713

[45] June 13, 1978

[54] SENSITIZING LIQUID EXPLOSIVES WITH HIGH GAMMA GAS

[75] Inventor: B. Arthur Breslow, Ridgecrest, Calif.

[73] Assignee: The United States of America as represented by the Secretary of the Navy, Washington, D.C.

[21] Appl. No.: 761,189

[22] Filed: Jan. 21, 1977

[51] Int. Cl.[2] ..... C06B 47/08

[52] U.S. Cl. ..... 149/36; 149/2; 149/46; 149/88; 149/101

[58] Field of Search ..... 149/2, 36, 46, 88, 101

[56] References Cited

U.S. PATENT DOCUMENTS

| | | | |
|---|---|---|---|
| 3,617,401 | 11/1971 | Mortensen et al. | 149/2 |
| 3,728,174 | 4/1973 | Reinhart | 149/2 |
| 3,770,522 | 11/1973 | Tomic | 149/2 |
| 3,797,392 | 3/1974 | Eckels | 149/2 |
| 4,008,108 | 2/1977 | Chrisp | 149/2 |

*Primary Examiner*—Edward A. Miller

*Attorney, Agent, or Firm*—R. S. Sciascia; Roy Miller; Lloyd E. K. Pohl

[57] ABSTRACT

Bubbles of high gamma gas are incorporated into the liquid component of a liquid or slurried explosive to sensitize the explosive.

16 Claims, No Drawings

SENSITIZING LIQUID EXPLOSIVES WITH HIGH GAMMA GAS

BACKGROUND OF THE INVENTION

1. Field of the Invention

This invention relates to the sensitization of explosive compositions.

2. Description of the Prior Art

When a liquid explosive is to be transported on a truck or train or the like, it usually must be desensitized. That is, it usually must be treated in some manner whereby it is made safe for transportation. When a slurried explosive is to be transported on a truck or train or the like it must be in a desensitized condition wherein the sensitizers have not yet been added. Inadvertent explosions are highly undesirable to say the least.

On the other hand, when such an explosive, whether it be liquid or slurried, is to be detonated it is undesirable to have it desensitized. At this time, easy detonation is desirable—not undesirable.

It is common practice to obtain a desensitizing agent, mix it with or dissolve it in a liquid explosive when the explosive is to be transported and then separate it from the explosive just before the explosive is to be detonated. For example, alcohol is commonly mixed with nitroglycerine for desensitization purposes and then removed just prior to use of the nitroglycerine in propellant processing. Slurried explosives are mixed at the point of usage in order to add the sensitizers. For example a large tank truck of slurried explosive ingredients will be pumped into a blasting hole via a pump track wherein the sensitizer ingredients are metered into the flow line. These practices are cumbersome and time-consuming. It would be desirable to avoid the necessity for the practices altogether but, unfortunately, no one has yet devised a way whereby the use of desensitizing agents in conjection with highly sensitive liquids can be avoided if the liquids are to be transported and, additionally, the on sight sensitization of slurried explosives goes on. Accordingly, the next best thing would be to avoid the necessity for removing desensitizing agents from liquid explosives and, additionally, it would be advantageous to provide a simple means for sensitizing liquids which are explosive but are naturally hard to detonate, i.e., liquids which need no desensitizing agents and to provide a similar means for sensitizing slurried explosives. (Note that, according to this invention, liquids which require no desensitizing agents are equated with slurried explosives which also need no desensitizing agents.

SUMMARY OF THE INVENTION

According to this invention, the necessity for removing a desensitizing agent from a liquid explosive prior to detonation of the explosive is removed by dispersing bubbles of a high gamma gas in the explosive just prior to detonation. The high gamma gas sensitizes the explosive and overcomes the effect of any desensitizing agent present. Such a gas may also be used to sensitize liquid explosives which contain no desensitizing agent, i.e., liquids which lack sensitivity and further, may be used to sensitize slurried explosives.

DESCRIPTION OF THE PREFERRED EMBODIMENT

The mechanical aspect of this invention may be practiced by utilizing any known technique for dispersing a gaseous material into a liquid at a desirable time. That is, those skilled in the mechanical arts will be quite capable of providing a gas containing a high gamma gas, providing the container with proper tubing leading from it into a manifolded container containing a liquid or slurried explosive to be sensitized and providing for the metering of gas into the explosive in a desirable amount at a desirable time. Therefore, no great detail is needed to enable one skilled in the art to practice the mechanical aspect of the invention.

As indicated above, a high gamma gas is used as the sensitizing material. The term gamma as used herein means the ratio of specific heat at constant pressure (Cp) to specific heat at constant volume (Cv). The term high means 1.6 or greater. Among gases which have gammas of 1.6 or greater are such well known gases as argon, krypton and helium.

To practice this invention, bubbles of high gamma gas are dispersed in the explosive, preferably just prior to use. This is true whether the explosive is a desensitized liquid, a non-desenitized liquid or a slurry.

High gamma gas bubbles will further sensitize an already highly sensitive liquid such as n-propyl nitrate. Additionally, high gamma gas will sensitize a mixture or solution of n-propyl nitrate and a desensitizing agent by overcoming the effect of the desensitizing agent.

High gamma gas will overcome the desensitizing effect of alcohol in nitroglycerine. It will also sensitize nitroglycerine. It will also sensitize nitroglycerine which contains no desensitizing agent.

High gamma gas will sensitize a slurry such as a slurry of ammonium nitrate, water and aluminum powder and other similar slurried explosives.

High gamma will sensitize a relatively insensitive composition such as a hydrazine-hydrazine nitrate composition. And, of course, it will sensitize hydrazine which is highly sensitive.

To be most effective, it is preferred that at least 1 volume percent of the composition be high gamma gas bubbles when the composition is ready for detonation. Up to 5 volume percent or more may be high gamma gas bubbles.

It is theorized that, when the gas in the bubbles is acted on by pressure produced by an initiator, the gas temperature is greatly increased and the hot gas decomposes surrounding liquid assisting the explosion to occur. The gas in any given gas bubble will not, of course, be entirely high gamma gas. It is practically impossible to keep gases such as oxygen and nitrogen from being present in liquids and such gases will naturally make up a portion of any bubble formed in the liquid. However, it is not necessary that the bubbles contain only high gamma gas. Bubbles need only contain a substantially large amount of suitable gas.

What is claimed is:

1. A method for sensitizing a liquid explosive that has a desensitizing agent added, said method comprising the steps of:

A. providing a high gamma gas, bubbles of which are capable of overcoming the effect of said desensitizing agent and B. bubbling said high gamma gas into said explosive.

2. A method according to claim 1 wherein said liquid explosive that has a desentizing agent added is a solution of n-propyl nitrate and a desensitizing agent.

3. A method according to claim 1 wherein said liquid explosive is nitroglycerine and wherein said desensitizing agent is alcohol.

4. A method according to claim 1 wherein said liquid explosive that has a desensitizing agent added is a hydrazine-hydrazine nitrate composition.

5. A method according to claim 2 wherein said high gamma gas is selected from the group consisting of argon, krypton and helium.

6. A method according to claim 3 wherein said high gamma gas is selected from the group consisting of argon, krypton and helium.

7. A method according to claim 4 wherein said high gamma gas is selected from the group consisting of argon, krypton and helium.

8. A method according to claim 5 wherein enough of said high gamma gas is bubbled into said explosive to make up from about 1 to about 5 volume percent of the total composition.

9. A method according to claim 6 wherein enough of said high gamma gas is bubbled into said explosive to make up from about 1 to about 5 volume percent of the total composition.

10. A method according to claim 7 wherein enough of said high gamma gas is bubbled into said explosive to make up from about 1 to about 5 volume percent of the total composition.

11. A sensitized explosive composition consisting essentially of n-propyl nitrate, a desensitizing agent and bubbles of a high gamma gas.

12. A sensitized explosive composition consisting essentially of nitroglycerine, alcohol and bubbles of a high gamma gas.

13. A sensitized explosive composition consisting essentially of hydrazine, hydrazine nitrate and bubbles of high gamma gas.

14. A composition according to claim 11 wherein said high gamma gas is selected from the group consisting of argon, krypton and helium.

15. A composition according to claim 12 wherein said high gamma gas is selected from the group consisting of argon, krypton and helium.

16. A composition according to claim 13 wherein said high gamma gas is selected from the group consisting of argon, krypton and helium.

* * * * *